US005769328A

United States Patent [19]

Zdyb et al.

[11] Patent Number: 5,769,328

[45] Date of Patent: Jun. 23, 1998

[54] FUEL INTERCONNECT FOR FUEL INJECTOR

[75] Inventors: Gary Michael Zdyb; Otto Muller-Girard, Jr., both of Rochester, N.Y.; Harrie William Bonnah, II, East Grand Rapids, Mich.

[73] Assignee: General Motors Corporation, Detroit, Mich.

[21] Appl. No.: 578,849

[22] Filed: Dec. 26, 1995

[51] Int. Cl.[6] ..... B05B 1/30

[52] U.S. Cl. ..... 239/585.4; 239/585.1; 251/129.18

[58] Field of Search ..... 239/585.1–585.5; 251/129.14, 129.18, 129.21, 148

[56] References Cited

U.S. PATENT DOCUMENTS

| | | | |
|---|---|---|---|
| 4,393,994 | 7/1983 | Rieck | 239/585 |
| 4,395,988 | 8/1983 | Knapp et al. | 123/469 |
| 4,423,842 | 1/1984 | Palma | 239/585 |
| 4,423,843 | 1/1984 | Palma | 239/585 |
| 4,502,632 | 3/1985 | Hafner et al. | 239/585.3 X |
| 4,621,772 | 11/1986 | Blythe et al. | 239/585 |
| 4,625,919 | 12/1986 | Soma et al. | 239/585 |
| 4,646,974 | 3/1987 | Sofianek et al. | 239/585 |
| 4,699,323 | 10/1987 | Rush et al. | 239/585 |
| 5,044,562 | 9/1991 | Rogers et al. | 239/543 |
| 5,295,627 | 3/1994 | Wahba | 251/129.15 X |
| 5,331,053 | 7/1994 | Reiter | 251/129.21 |

FOREIGN PATENT DOCUMENTS

WO95/33134 12/1995 WIPO .

*Primary Examiner*—Andres Kashnikow
*Assistant Examiner*—Steven J. Ganey
*Attorney, Agent, or Firm*—Karl F. Barr, Jr.

[57] ABSTRACT

A fuel injector for discharging fuel to an internal combustion engine is disclosed. The injector includes a nozzle body having a solenoid actuator, a pole piece with an axial extending fuel passage, a valve assembly including a reciprocably moveable armature operable against the bias of a spring member, a calibration tube extending through the pole piece fuel passage and operable to load the spring, an axially extending, drawn metal fuel tube having a first end defining an injector fuel inlet and a second end in communication with the axially extending fuel passage of the pole piece. The fuel tube includes features which extend radially inwardly in the wall of the fuel tube to define depressions in the outer surface of the wall which function, with a molded composite jacket to deter rotation of the tube. Additionally, the features define radial inward projections from the inner surface of the tube wall and may be used to position the filter assembly and to align externally installed components of the injector.

4 Claims, 7 Drawing Sheets

FUEL INTERCONNECT FOR FUEL INJECTOR

TECHNICAL FIELD

The invention relates to fuel injectors for delivery of fuel to the intake system of an internal combustion engine.

BACKGROUND

Advancement in materials and production technology has allowed the solenoid actuator and valve portions of electromagnetic fuel injectors to be substantially reduced in size, when compared to earlier devices. The diminutive stature of the "new generation" of injectors requires a rigid interconnection between the actuator and the fuel delivery manifold or fuel rail if the injectors are to be used interchangeably with the older, larger units.

Injectors requiring this type of fuel extension between the actuator and the fuel source have relied on a one piece, screw machined injector body and fuel inlet tube having tightly controlled internal and external tolerances. Such careful attention to tolerances is required to prevent misalignment or loss of the fuel filter assembly carried in the inlet and is also required for proper sealing at the injector, fuel rail interface. The provision of the described one piece, screw machined, interconnect tube is costly in both material and handling and does not facilitate fuel injector length changes to accommodate varying applications.

SUMMARY

Accordingly, it is an object of the present invention to provide an electromagnetic fuel injector, for use in an internal combustion engine, having a separate fuel interconnect constructed of an inexpensive, deep drawn tube.

A feature of the invention is to provide a deep drawn interconnect tube having an inlet for attachment to the injector port of a fuel rail and an outlet configured for sliding engagement with a portion of the solenoid actuator assembly. The deep drawing process for forming the fuel interconnect tube allows precise control of selected internal and external dimensions of the tube. As such, the interface between the tube and the solenoid actuator is controlled as well as the dimensions at the connection between the tube and fuel rail. A further advantage to controlling the inner dimensions of the drawn tube is in the area of the fuel filter disposed adjacent the inlet end of the tube. The fuel filter must be carefully controlled within the interconnect tube to prevent translation of the filter towards the solenoid actuator.

An additional feature of the invention is to provide an overmolded jacket about the exterior of the fuel interconnect tube allowing precise control of the injector external dimensions. Such external dimensional requirements are of concern in the area of o-ring retention at the injector-fuel rail interface. The overmolded jacket may function to permanently seal the fuel tube at its connection to the solenoid actuator.

A feature of the present invention may be the provision of anti-progression dimples in the tube wall which extend into the tube inner diameter and operate to limit the downstream translation of the fuel filter assembly in the tube. In addition the dimples function, with respect to the overmolded jacket to prevent rotation of the fuel tube.

A feature of the present invention may also include the provision of alignment channels in the tube which extend into the tube inner diameter and operate to improve component alignment during automatic assembly of the injector.

As an example, the calibration tube used in the disclosed injector must be inserted, through the fuel tube, into the pole piece of the solenoid actuator. The alignment features create an inscribed opening that targets the components through the fuel tube and past the projecting shoulder on the mating pole piece.

An embodiment of the present invention is described below, by way of example only, with reference to the accompanying drawings.

DESCRIPTION OF THE PREFERRED EMBODIMENTS

Figure 1:
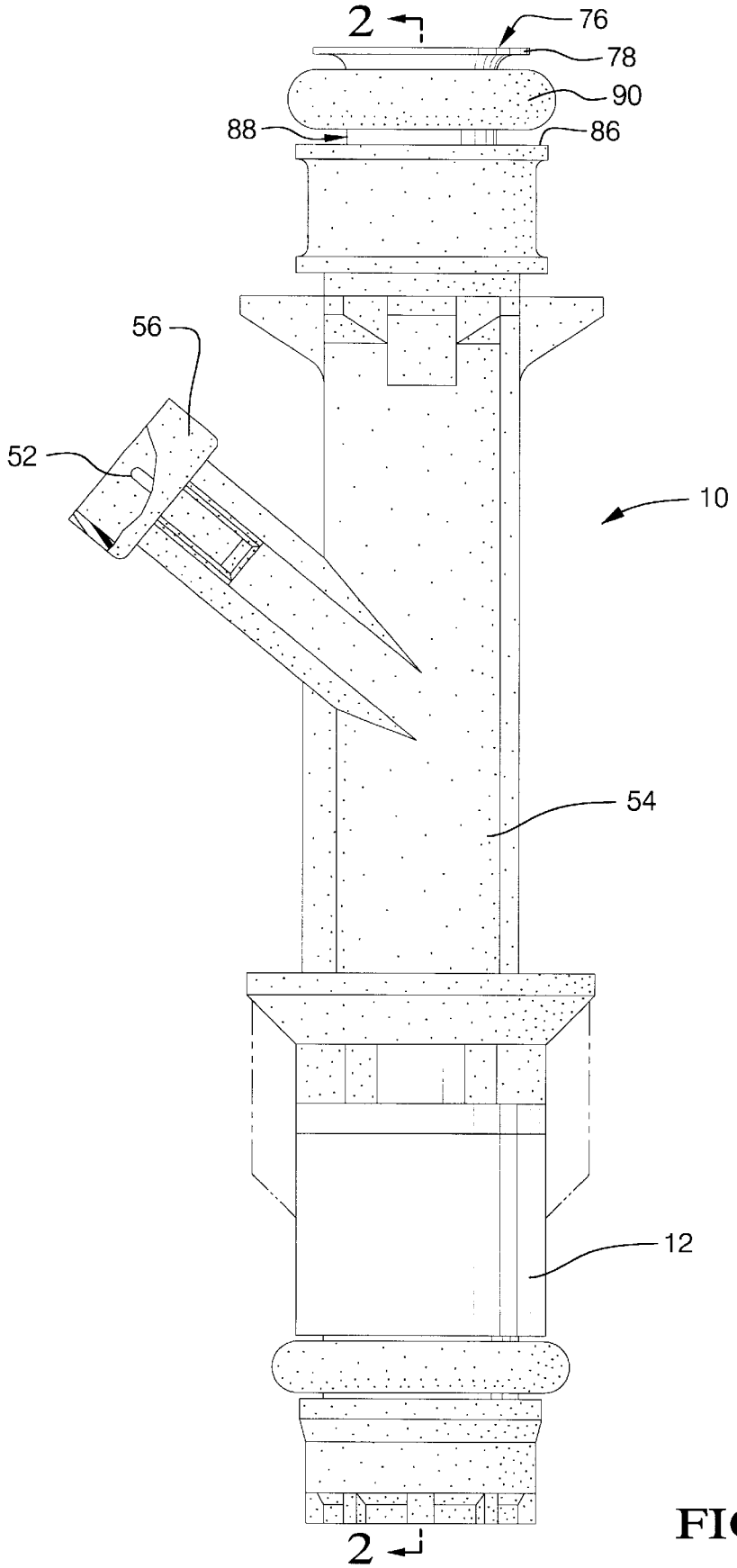
FIG. 1 is a side view of a fuel injector embodying features of the present invention.
Figure 2:
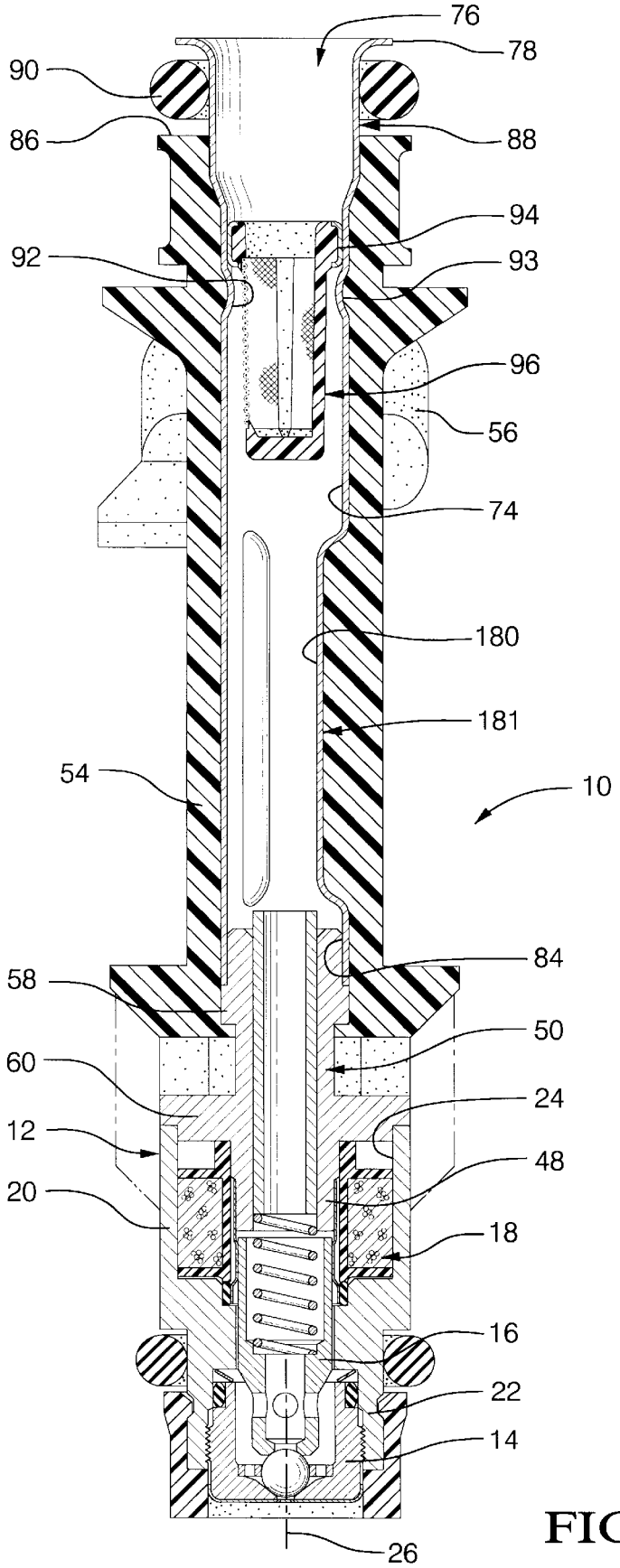
FIG. 2 is a sectional view of the fuel injector of FIG. 1 taken along line 2—2 of FIG. 1.
Figure 3:
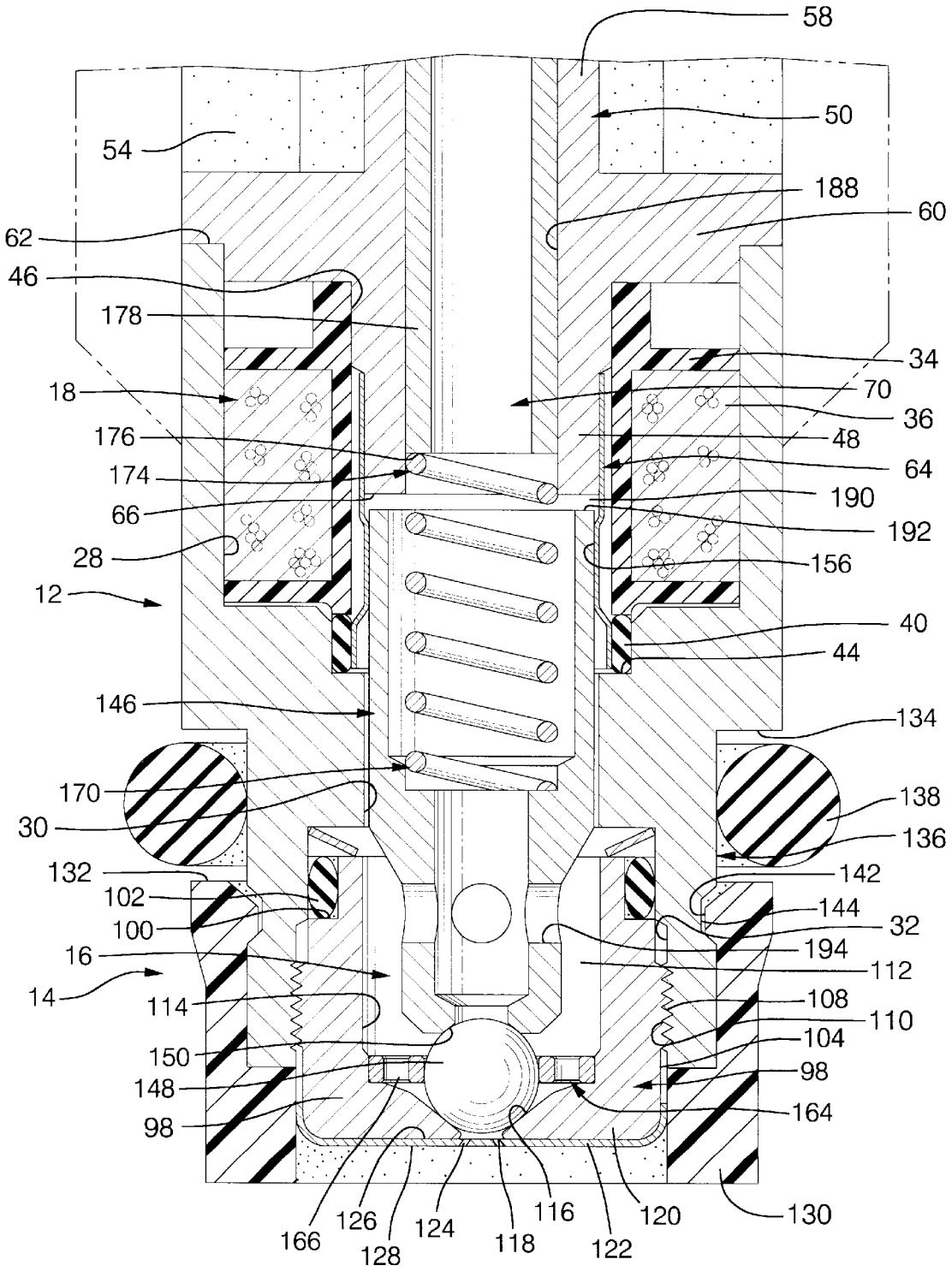
FIG. 3 is an enlarged cross section of a portion of FIG. 2.
Figure 4:
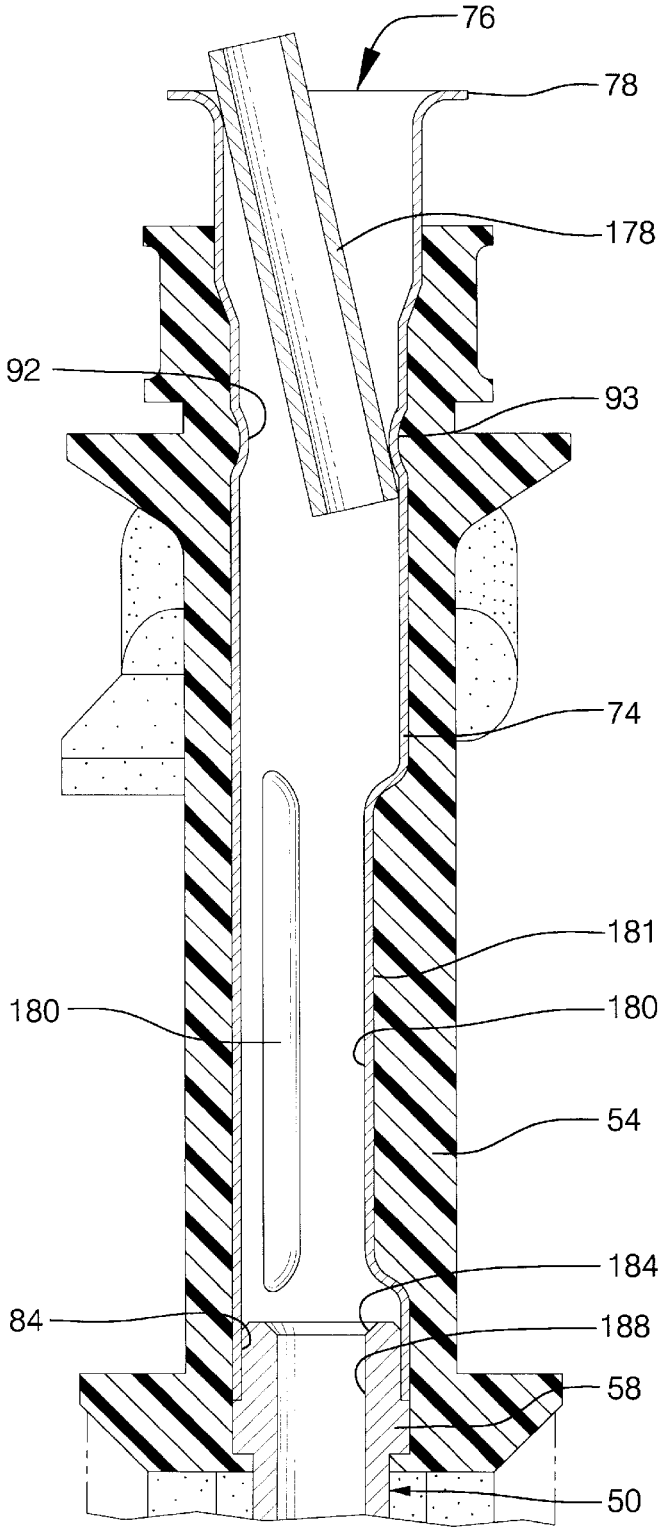
FIGS. 4, 5 and 6 are enlarged cross sections of a portion of FIG. 2 which illustrate the installation sequence of the injector calibration tube.
Figure 5:
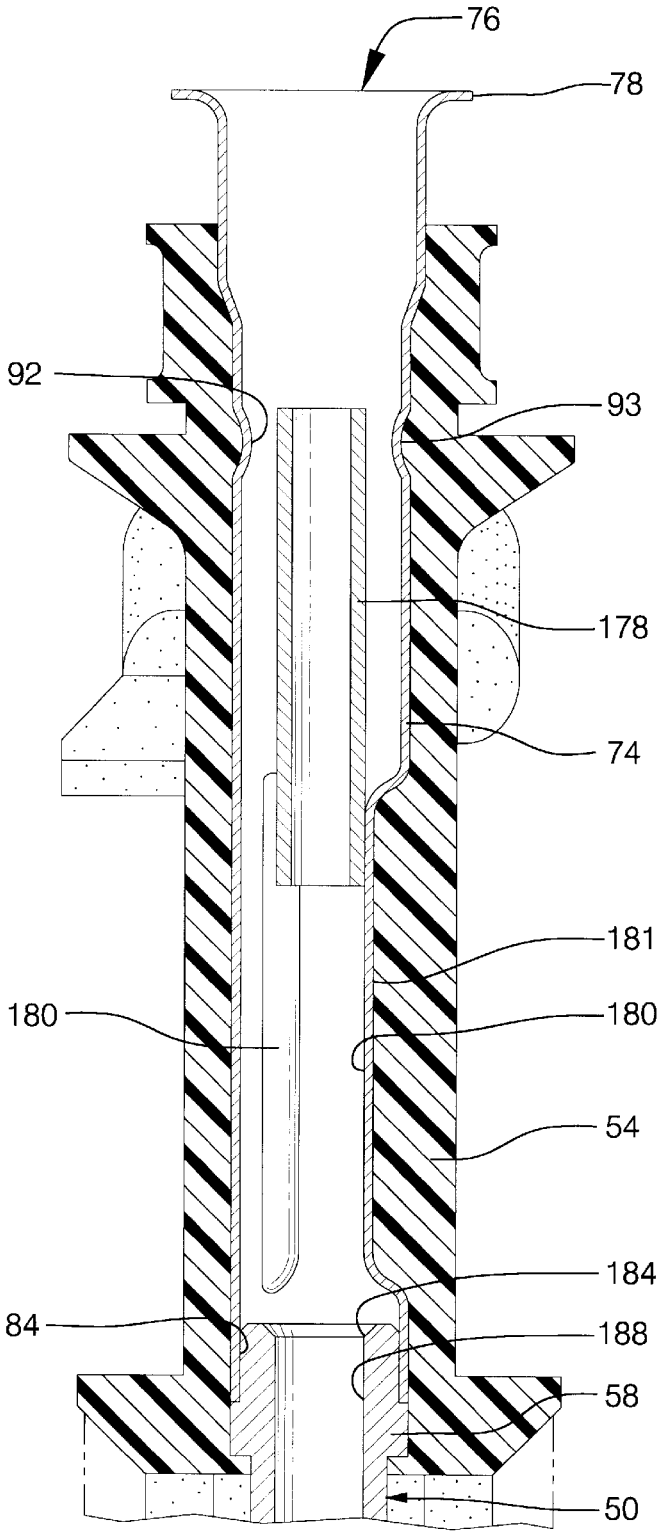
Figure 6:
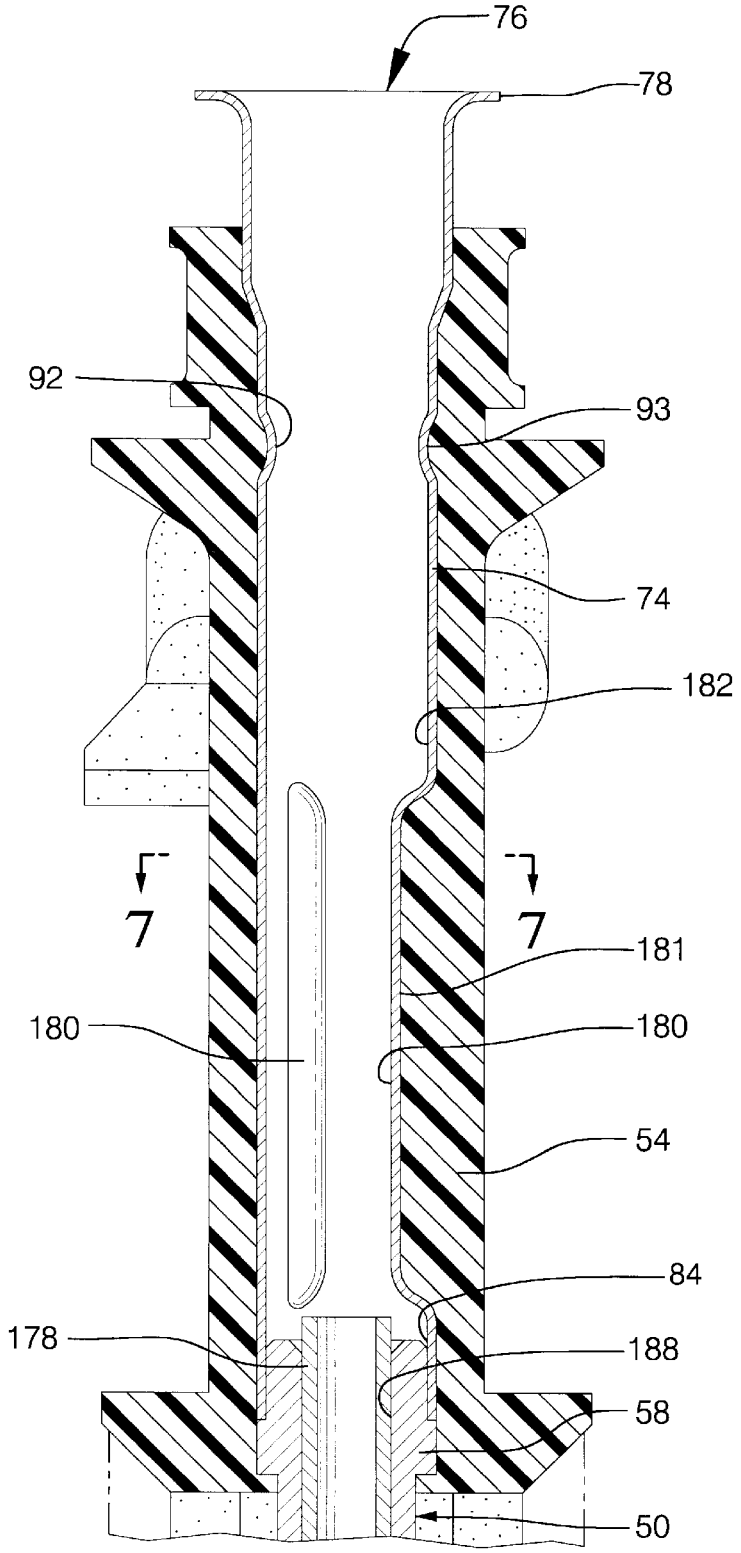
Figure 7:
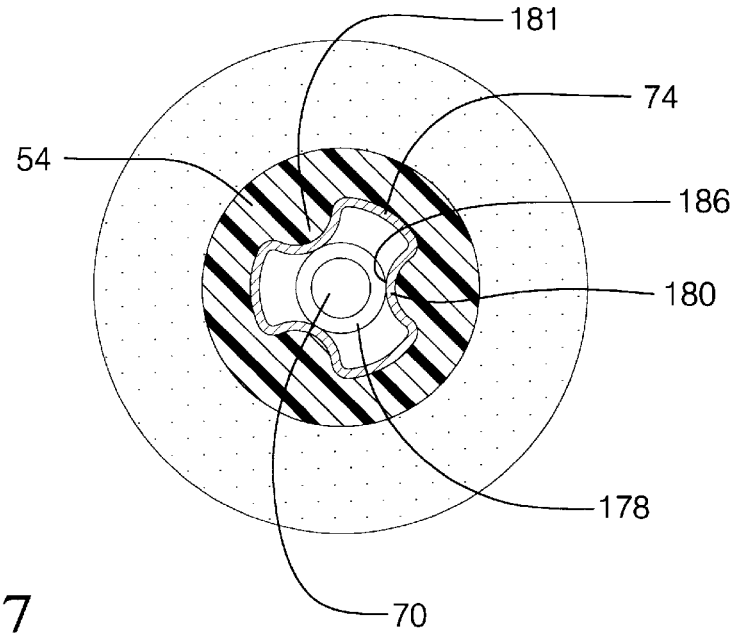
FIG. 7 is a sectional view of the injector of FIG. 2 taken along line 7—7 of FIG. 6.
Figure 8:
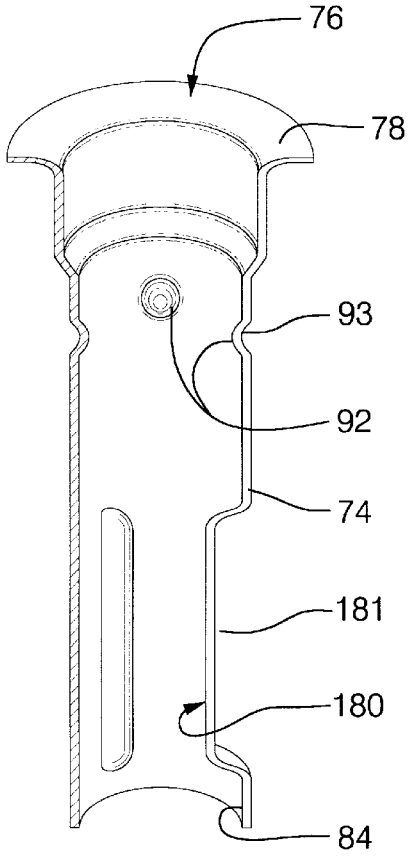
FIG. 8 is a perspective view, in section of the fuel tube of the fuel injector of FIG. 1.

Referring to FIGS. 1–3, an electromagnetic fuel injector, designated generally as 10, includes as major components thereof a body 12, a nozzle assembly 14, a valve member 16 and a solenoid assembly 18 used to control the movement of the valve member 16.

In the construction illustrated, the body 12 is of cylindrical, hollow tubular configuration and is of such external shape as to permit direct insertion, if desired, of the injector 10 into a socket provided for this purpose in an engine intake manifold, not shown.

The body 12 includes an enlarged upper solenoid case portion 20 and a lower end, nozzle case portion 22 of reduced internal and external diameter relative to the solenoid portion 20. An internal cylindrical cavity 24 is formed in the body 12 by a stepped bore therethrough that is substantially coaxial with the axis 26 of the body. In the construction shown, the cavity 24 includes a cylindrical upper wall 28, a cylindrical intermediate wall 30 and a cylindrical lower wall 32. Wall 30 is of a reduced diameter relative to upper and lower wall portions 28 and 32, respectively.

Solenoid assembly 18 is disposed within the enlarged upper solenoid case portion 20 and includes a spool-like, tubular bobbin 34 supporting a wound wire solenoid coil 36. A resilient sealing member such as o-ring 40 is disposed between the tubular bobbin 34 and seal shoulder 44 in the cylindrical intermediate wall 30. The bobbin 34 is provided with a central through bore 46 configured to encircle the lower, reduced diameter portion 48 of pole piece 50. A pair of terminal leads 52 are operatively connected at one end to the solenoid coil 36 and each such lead has its second end extending upwardly through an outer, overmolded jacket or casing 54 to terminate in a socket 56, for connection of the fuel injector to a suitable source of electrical power in a manner well known in the art.

Pole piece 50 includes an upper cylindrical portion 58, a centrally located circular, radial flange portion 60 and the lower reduced diameter cylindrical pole 48. The circular, radial flange portion 60 is slidably received at its outer peripheral edge within the cylindrical upper wall 28 of the body 12 to close the enlarged upper solenoid case portion 20 of the body 12 and retain the solenoid assembly 18 therein. The pole piece 50 is axially retained within the upper cylindrical portion of the body 12 as by having its flange portion welded or otherwise suitably bonded to the shoulder 62 along the upper, opened end of wall 28.

Formed integral with the pole piece 50 and extending downwardly from the flanged portion 60 is the lower cylindrical pole 48. Pole 48 is of a suitable exterior diameter so as to be slidably received in the central through bore 46 that extends coaxially through the coil bobbin 34. Received about the lower end of the lower cylindrical pole 48 of the pole piece 50, a cylindrical tube 64 of non-magnetic material such as stamped or drawn metal may be welded or bonded or otherwise sealed to the lower pole piece 48 so as to prevent fuel penetration of the joint between the tube 64 and the pole. The tube 64 extends axially downwardly beyond the lower end 66, working surface of the lower cylindrical pole 48. The outer surface of the extended portion of the tube 64 may act as an interface with resilient sealing member 40 seated between the lower end of the coil bobbin and seal shoulder 44 of the body 12, thereby operating to seal the central, fuel passage 70 of the fuel injector 10 from solenoid assembly 18.

The pole piece 50, in the construction illustrated, is also provided with an upwardly extending cylindrical boss 58 surrounding the inlet to central through bore 46. The boss 58 is configured to receive an axially upwardly extending, deep drawn fuel inlet tube 74. The inlet tube has a first inlet end 76 having a flanged end portion 78, and a second end portion 84 having a diameter configured to be slidingly received over the cylindrical boss 58 of the pole piece 50. The deep drawn fuel inlet tube is preferably formed using sheet stock which results in a final product having a nominal wall thickness. The fuel inlet tube 74 is fixed to the pole piece 50 by welding the components about their perimeter and subsequently overmolding the two components to form jacket or housing 54. The housing is formed of a suitable encapsulant material which, as described above, also includes an integral terminal socket 56 with leads 52. The encapsulant allows selected inner and outer diameters of the fuel inlet tube to be tightly controlled in the drawing process while the outer diameter of the housing portion 54 of injector 10 is controlled, if required, in the dimensions of the molded encapsulant. Should precise tolerances be required at differing internal and external locations along the fuel inlet tube 74, the drawing process is flexible enough to allow such tolerances to be controlled. An upper seal shoulder 86 formed in the overmolded housing 54 is axially spaced from the tube flange 78 to define an annular seal groove 88 configured to carry a resilient sealing member such as o-ring 90 for leak free attachment to a source of pressurized fuel, not shown.

Intermediate of the first and second ends, 76 and 84 of the inlet tube 74, radially inwardly extending dimples 92 are disposed for engagement with the flanged portion 94 of the injector fuel filter assembly 96. The dimples 92 inhibit undesirable downstream translation of the filter assembly 96 in the fuel inlet tube 74.

The nozzle assembly 14 includes a nozzle body 98 having a cup-shaped, tubular configuration with a stepped upper shoulder 100 for receiving a sealing member such as o-ring 102. The sealing member 102 is disposed between the shoulder 100 of the nozzle body 98 and the lower wall 32 of the lower end nozzle case portion 22 of the body 12, thereby establishing a seal against leakage at the interface of the nozzle assembly 14 and the body 12. The nozzle body 98 includes a series of external threads 108 which engage corresponding internal threads 110 in the lower wall 32 of the body 12 providing axial adjustability of the nozzle body within the injector body. An internal cylindrical cavity 112 in the nozzle body 98 is defined by an inner cylindrical wall 114 which extends from the open, upper end of the nozzle body to terminate in an annular, frustoconical valve seat 116 disposed about an axially aligned, fuel discharge opening 118 at the lower end thereof.

Over the exterior of the lower end 120 of the nozzle body 98 is placed a fuel spray director plate 122. The director plate 122 is formed of thin sheet stock and has fuel directing openings 124 extending from the upstream side 126 to the downstream side 128. Fuel passing through the fuel discharge opening 118 in the valve seat 116 is delivered to the upstream side, or face 126 of the director plate 122 where it is distributed across the face to the fuel openings 124. The openings 124 are oriented in a predetermined configuration which will generate, in the discharged fuel, a desired spray configuration.

A cylindrical retainer sleeve 130 is also engaged over the lower end 120 of nozzle body 98. The retainer includes an upper annular shoulder 132 which defines, with shoulder 134 of body 12, an annular groove 136 for the placement of resilient sealing member 138. The downstream end of the retainer sleeve 130 extends beyond the downstream side 128 of the director plate 122 and functions to protect the director plate 122 from contact with surfaces which could damage the plate thereby altering the precise alignment of the fuel directing orifices 124. The cylindrical retainer sleeve 130 is preferably constructed of a durable, temperature resistant plastic such as nylon and is snapped over the lower end, nozzle case portion 22 of the body 12.

Referring now to the valve member 16, it includes a tubular armature 146 and a valve element 148, the latter being made of, for example, a spherical ball having a predetermined radius, which is welded to the lower annular end 150 of the tubular armature 146. The radius of the valve element 148 is chosen for seating engagement with the valve seat 116. The tubular armature 146 is formed with a predetermined outside diameter so as to be slidable within the central aperture portion 156, of fuel passage 70, defined by the cylindrical tube 64 extending from the lower pole piece 48.

Positioned within the cylindrical cavity 112 of the nozzle body 98, adjacent the valve seat 116, is an annular valve guide 164. The valve guide 164 extends about the valve ball member 148 and is operable to guide the member as it moves reciprocally into and out of engagement with the valve seat 116. Fuel openings 166, extend through the valve guide 164 at circumferentially spaced locations about the annulus to allow fuel to move freely from the fuel collecting internal cylindrical cavity 112 to the valve seat 116.

The valve element 148 of valve member 16 is normally biased into a closed, seated engagement with the valve seat 116 by a biasing member such as valve return spring 170 of predetermined spring force. A calibration sleeve 178 adjusts the spring preload exerted on the valve member 16 in the direction of the valve seat 116.

As shown in FIGS. 4–8, installation of the calibration sleeve 178 may be facilitated through the disposition of axially extending channels 180 in the fuel inlet tube 74. The channels extend radially inwardly in the wall 182 of the fuel tube and, while located intermediate of the first and second ends 76,84 of the tube, preferably extend to a location closely adjacent the inlet 184 in the cylindrical boss 58 of the pole piece 50. The channels 180 define an inscribed passage, shown in cross-section in FIG. 7, such that the diameter of the passage, defined by the peaks 186 of the channels 180 are in coaxial alignment with the axial pole piece passage 188. Upon insertion of the calibration tube 178 into the first end 76 of the tube 74, FIG. 4, the peaks 186 of the channels slidingly engage the tube 178, FIG. 5, and position it with respect to the axial pole piece passage 188 in pole piece 50 through which it is to be inserted, FIG. 6. The channels greatly facilitate the installation of the calibration tube 178 by minimizing the opportunity for the end loaded tube to become lodged against the cylindrical boss 58 during insertion. It should be noted that the axially extending channels 180 can also provide the same function as the previously described dimples 92 in preventing the translation of the fuel filter assembly 96 through the tube 74.

Imposition of the axially extending channels 180 and, if required, the dimples 92 in the fuel tube 74 of the injector 10, not only results in the radially inwardly extending features described above, but also defines a series of associated depressions 181 and 93 respectively, in the exterior of the fuel tube 74.

During the overmolding of the outer casing 54, the encapsulant fills the depressions 181 and 93 in the outer surface of the tube 74 and, as a result, rotationally fixes the tube 74 relative to the outer casing 54.

A working air gap 190 is defined between the working surface 192 at the upper end of armature tube 146 of the valve member 16 and the working surface 66 at the lower end of the pole piece 50. Upon energization of the solenoid assembly 18, the tubular armature 146 and associated valve element 148 is drawn upwardly and off of the valve seat 116 against the bias of the spring member 170 to close the working air gap 190. Fuel flows from the pressurized source into the first, inlet end 76 of the fuel inlet tube 74 where it passes through the filter element of the filter assembly 96. Fuel flows the length of the tube 74 and enters the central fuel passage 70 through the pole piece 50 defined by the internal diameter of the calibration sleeve 178. Fuel flows through the tubular armature 146 and into the fuel chamber 112 in nozzle body 98 through circumferentially spaced openings 194 in the second end of the armature tube 146. As described above, the fuel passes through the openings 166 in the valve guide 164 and exits the valve body 98 through the opening 118 in valve seat 116. Fuel exiting the valve seat 116 is distributed onto the upstream side 126 of the fuel director plate 122 where it is distributed to the fuel director orifices 124 passing through the plate, for discharge from the fuel injector 10. Deenergization of the solenoid assembly 18 allows the field within the magnetic circuit defined by the pole piece 50, the body 12, and the armature 146 to collapse thereby allowing the valve member to return to the closed position against the valve seat 116 under the bias of the spring member 168 to stop the flow of fuel therethrough.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described were chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A fuel injector for discharging fuel to an internal combustion engine comprising an injector body having a solenoid actuator including a pole piece with a fuel inlet, an axially extending, thin walled fuel tube having a first end defining an injector fuel inlet, a second end slidingly received about said pole piece fuel inlet, and, a fuel filter disposed in said fuel tube, said fuel tube encased in a composite jacket and including radially inwardly extending dimples intermediate of said first and second ends, said dimples defining depressions in the outer surface of said fuel tube and operable to deter rotation of said fuel tube within said composite jacket and said dimples defining radial inward projections in said fuel tube operable to limit translation of said fuel filter in said tube.

2. A fuel injector for discharging fuel to an internal combustion engine comprising an injector body having a solenoid actuator including a pole piece with an axial extending fuel passage, a valve assembly including a reciprocably moveable armature operable against the bias of a spring member, a calibration tube extending through said fuel passage in said pole piece and operable to load said spring member, an axially extending, thin walled fuel tube having a first end defining an injector fuel inlet and a second end in communication with said axially extending fuel passage of said pole piece, said fuel tube encapsulated in a composite jacket, and including radially inwardly extending axial channels intermediate of said first and second ends, said channels defining depressions in the outer surface of said fuel tube and operable with said composite jacket to deter rotation of said tube therein and said channels defining radial inward projections in said fuel tube operable to align said calibration tube with said fuel passage in said pole piece and limit translation of said fuel filter therein.

3. A fuel injector, as defined in claim 2, said radial, inward projections of said axially extending channels defining an inscribed passage through said fuel tube having a diameter, defined by peaks of said projections, in axial alignment with said pole piece fuel passage.

4. A fuel injector, as defined in claim 3, said peaks of said projections configured for circumferential, sliding engagement with said calibration tube.

* * * * *